United States Patent [19]

Spooner et al.

[11] 4,019,286

[45] Apr. 26, 1977

[54] HONE FOR INVOLUTE KNIFE

[75] Inventors: Robert J. Spooner; Oscar W. Dillon, both of Essex, Conn.

[73] Assignee: Cashin Systems Corporation, Williston Park, N.Y.

[22] Filed: Jan. 26, 1976

[21] Appl. No.: 652,230

[52] U.S. Cl. ..... 51/248

[51] Int. Cl.[2] ..... B24B 3/40

[58] Field of Search ..... 51/247–249; 83/174, 174.1

[56] References Cited

UNITED STATES PATENTS

| | | | |
|---|---|---|---|
| 1,467,791 | 9/1923 | Hood | 51/248 |
| 2,738,628 | 3/1956 | Lust | 51/247 |
| 2,933,865 | 4/1960 | Miller | 51/249 |
| 2,978,848 | 4/1961 | Raine | 51/247 |
| 3,820,289 | 6/1974 | Good | 51/248 |

*Primary Examiner*—Al Lawrence Smith
*Assistant Examiner*—Nicholas P. Godici
*Attorney, Agent, or Firm*—Kane, Dalsimer, Kane, Sullivan and Kurucz

[57] ABSTRACT

A hone for sharpening an involute rotary knife blade on a machine, such as a slicing machine, in which the grinding assembly is adjustably secured to the end of a pivot hone arm adjustably mounted on the machine. The length of the arm (location of the grinding assembly on the arm) and the alignment of the hones on the grinding assembly are so selected that the hones maintain proper tracking on the knife edge from the highest to the lowest points of the blade while rotating such blade.

6 Claims, 8 Drawing Figures

HONE FOR INVOLUTE KNIFE

BACKGROUND OF THE INVENTION

This invention relates to an improvement in a hone for sharpening rotary knife blades and more particularly to knife sharpening means for slicing machines of the type embodying non-circular or involute rotary knives whereby the knives may be sharpened in situ without necessitating removal thereof from the slicing machine. The sharpening apparatus which has been illustrated herein is in the form of an attachment for existing slicing machines, but may by suitable modification be designed as original equipment on a slicing machine as manufactured.

Raine U.S. Pat. No. 2,978,848 discloses a grinder for sharpening an involute knife. The grinding wheel is positioned on the knife edge by means of a guide block, which rides on one of the beveled knife edge surfaces. However, as a practical matter, because of the geometry of the vertical movement of the guide block, the grinding wheel only approximately follows a portion of the knife edge. The result is that the entire knife edge is not satisfactorily sharpened.

Goode U.S. Pat. No. 3,820,289 sets forth the disadvantages of the device of the Raine U.S. Pat. No. 2,978,848 and points out how it is an improvement. However, the Goode grinder assembly is mounted on an arm which has a yoke at its lower end to which are bolted fingers. The yoke fingers engage the shaft of the knife shaft. The yoke and fingers are guided by the knife shaft to adjust the angle of the arm on which the assembly is mounted with respect to the radius of said shaft. The assembly of the present invention eliminates the necessity for the yoke and fingers of Goode and is an improvement over the apparatus of that patent.

Other patents, such as those cited in the Raine and Goode patents, disclose devices for sharpening circular knives, but none show the assembly of the present invention.

SUMMARY OF THE INVENTION

It is an object of the invention to provide an improved hone for sharpening an involute rotary knife blade which hone can be mounted on a machine, such as a slicing machine, to sharpen the blade in situ without the necessity of removing the blade from the machine.

It is a further object to provide a hone which has the grinding assembly adjustably secured to the end of an arm adjustably mounted on the machine whereby the arm and grinding assembly can be positioned to insure proper alignment and tracking of the assembly on the blade from the highest to the lowest points of the blade while rotating such blade.

It is a further object to provide a hone of the type described which is simple to mount on the machine, adjust and operate, is economical to manufacture, and is efficient and well suited for its intended purpose.

BRIEF DESCRIPTION OF THE DRAWINGS

Other objects and advantages will become apparent from the following description which is to be taken in conjunction with the accompanying drawings, in which.

DESCRIPTION OF THE PREFERRED EMBODIMENT

Figure 1A:
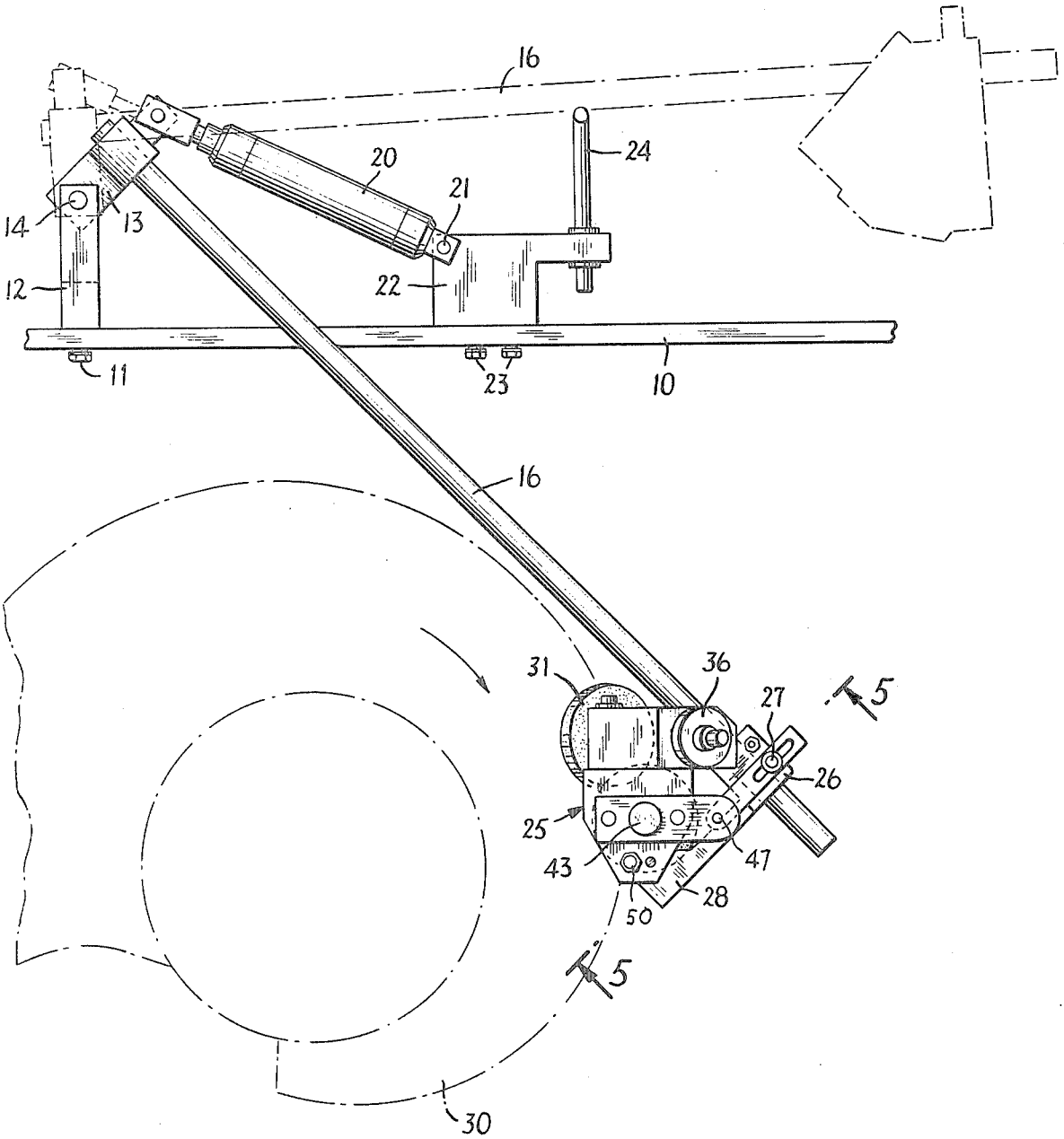
FIG. 1A is a front elevational view of the hone of the present invention contacting the knife blade.
Figure 1B:
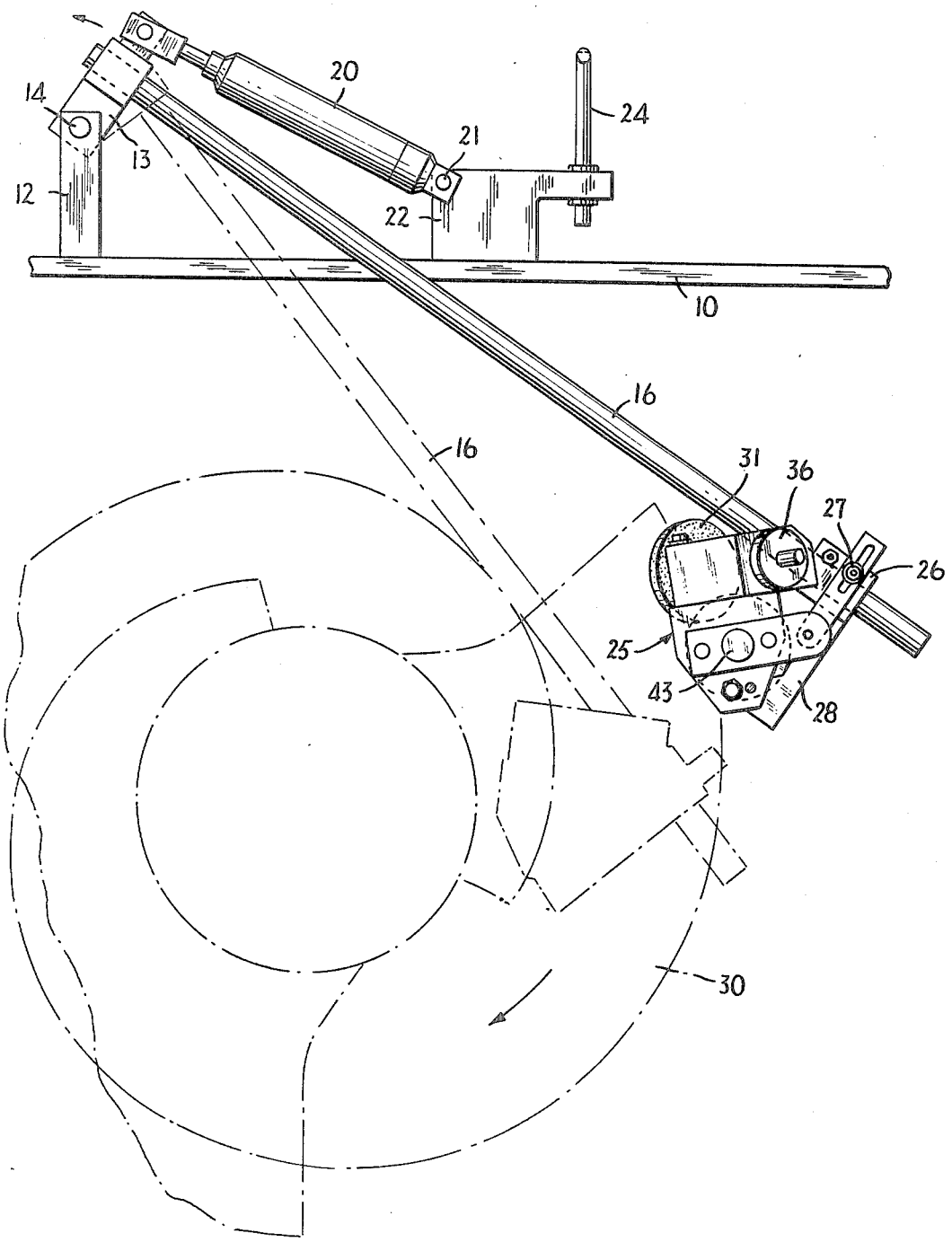
FIG. 1B is a view similar to that of FIG. 1A with the hone contacting the knife blade at a greater radius of the blade.
Figure 2:
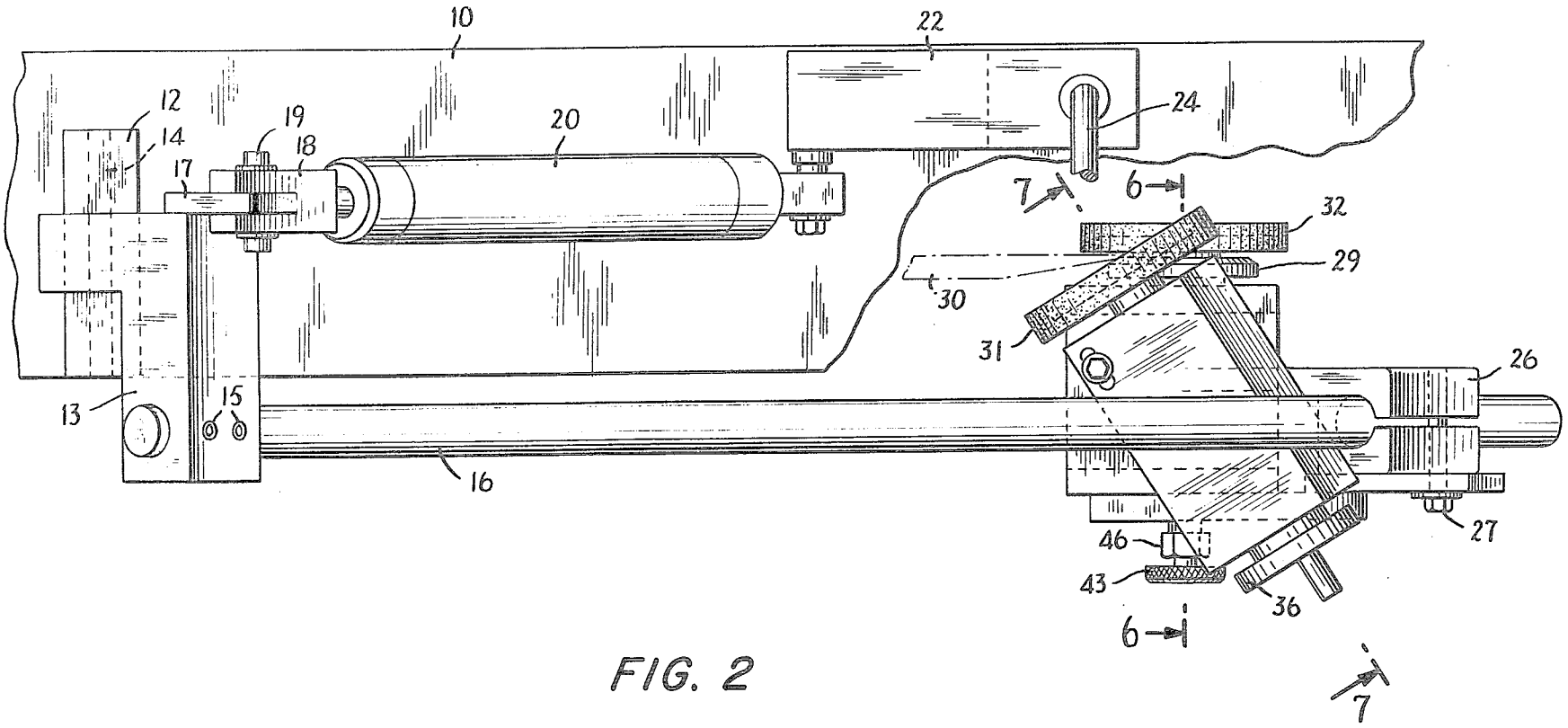
FIG. 2 is a top plan view of the hone.
Figure 3:
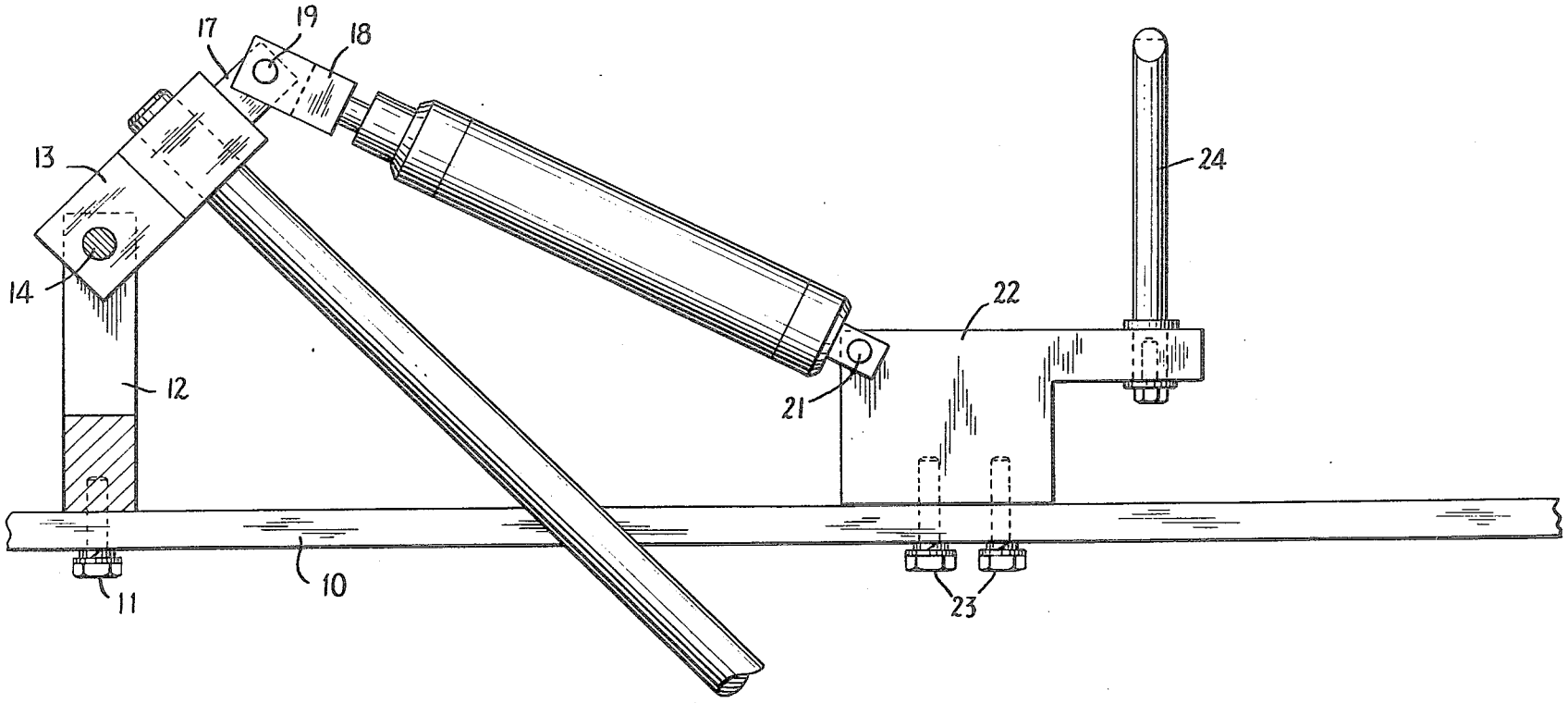
FIG. 3 is a front elevational view showing the mounting of the hone arm and cylinder on the front bearing housing.

Referring to the drawings, there is shown in FIGS. 1A, 2 and 3 a portion of the front bearing housing 10 of the machine on which is mounted by screws 11 a hone arm mounting bracket 12 having a U-shape. The short leg of an L-shaped spacer 13 is rotatably mounted in the slot of the bracket 12 on a shaft 14. Affixed by screws 15 to one end of the long leg of the spacer 13 is one end of a hone arm 16 and to the other end of the long leg by a plate 17, clevis 18 and pin 19 is a dash-pot or cylinder 20. The other end of the cylinder is affixed by screw 21 to a cylinder mounting bracket 22 also mounted by screws 23 on the front bearing housing 10. Also rotatably set into the cylinder mounting bracket 22 is a rest arm 24 provided with a groove (not shown), so that the hone arm and the hone assembly when not in use can be rested in the groove of the rest arm out of the way of the knife blade 30.

A honing head assembly 25 (FIGS. 1A and 4) is adjustably mounted on the hone arm 16 at the end away from the mounting bracket 12 by means of a split clamp 26 and screws. Such clamp 26 forms a part of a bracket 28 to which the honing head assembly 25 is affixed. Referring to FIGS. 2, 5 and 6, the honing head assembly 25 comprises a guide wheel 29 which is centered on the knife blade 30 to properly track the hones, an angled hone 31 positioned to contact the beveled edge of the knife blade, and a vertical hone 32 to remove the burrs on the flat back edge of the knife blade 39.

Figure 7:
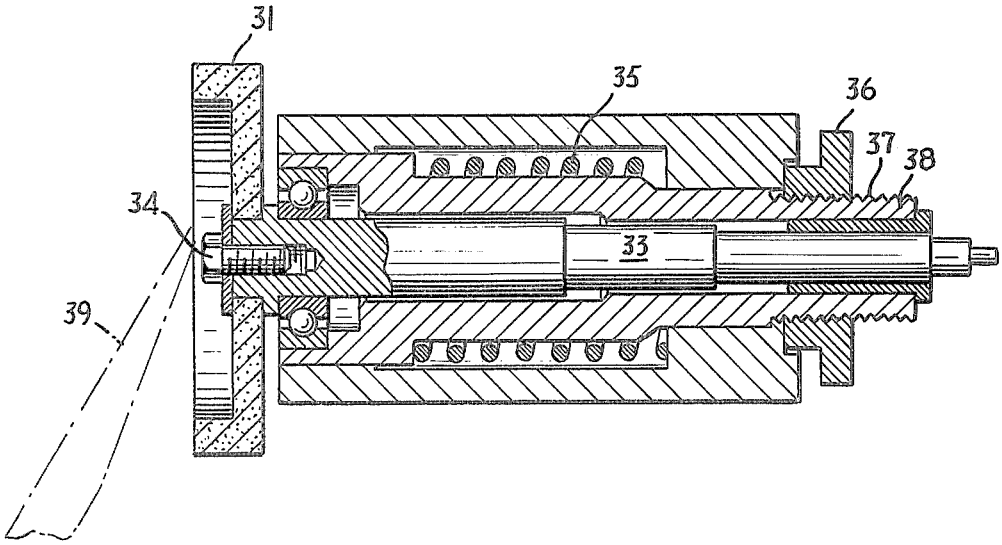
FIG. 7 is a view, with some parts in section, along the line 7—7 of FIG. 2.

Referring to FIG. 7, the angled hone 31 is mounted on a shaft 33 with a screw 34. Such shaft is spring loaded by a spring 35 and an adjusting knob 36 which engages threads 37 on housing 38 for the shaft 33. The spring loading provides even pressure of the grinding wheel surface on the surface of the knife 30 and compensates for errors in the knife.

Referring to FIG. 6, the guide wheel 29 is mounted on a shaft 40 and the vertical hone 32 is secured to the end of such shaft by a screw 41. Such shaft is spring loaded by a spring 42, an adjusting knob 43 secured to a threaded rod 44 engaging the end of the shaft 40. The threaded rod 44 engages threads in a retaining ring 45 and is set in adjustment with a check nut 46. The purpose of the spring loading is the same as for the angled hone.

Figure 4:
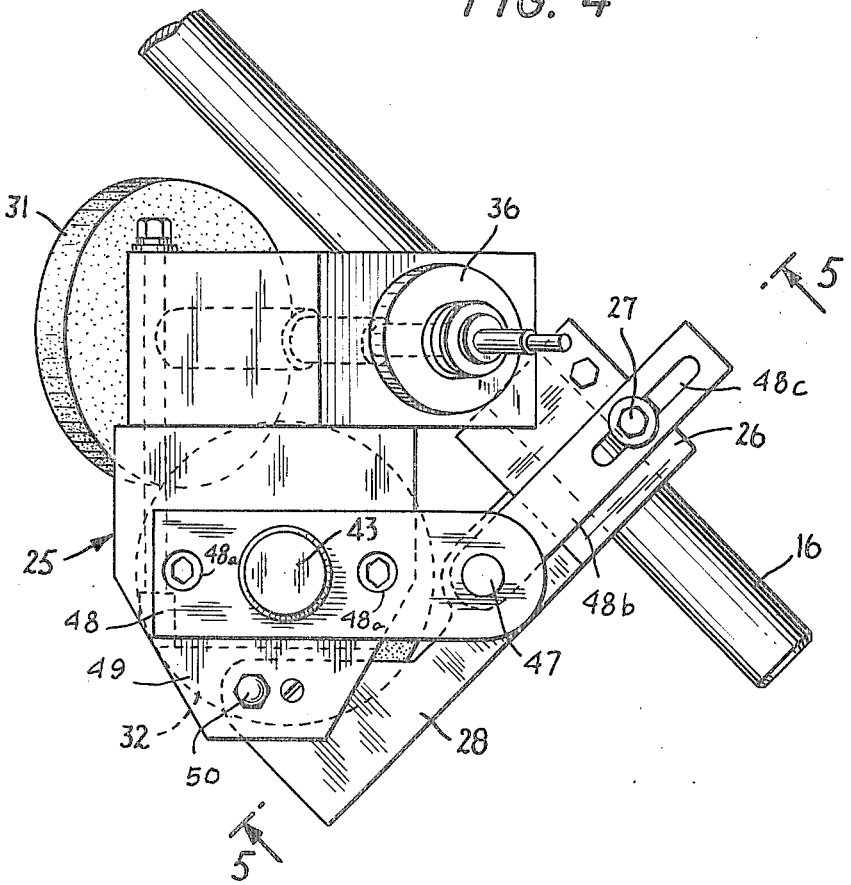
FIG. 4 is a front elevational view of the honing head.
Figure 5:
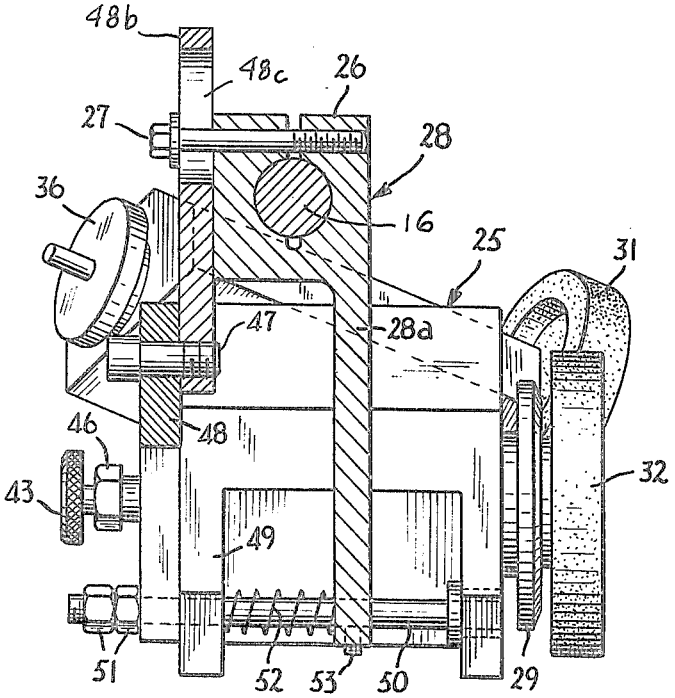
FIG. 5 is a view with some parts in section, along the line 5—5 of FIG. 4.
Figure 6:
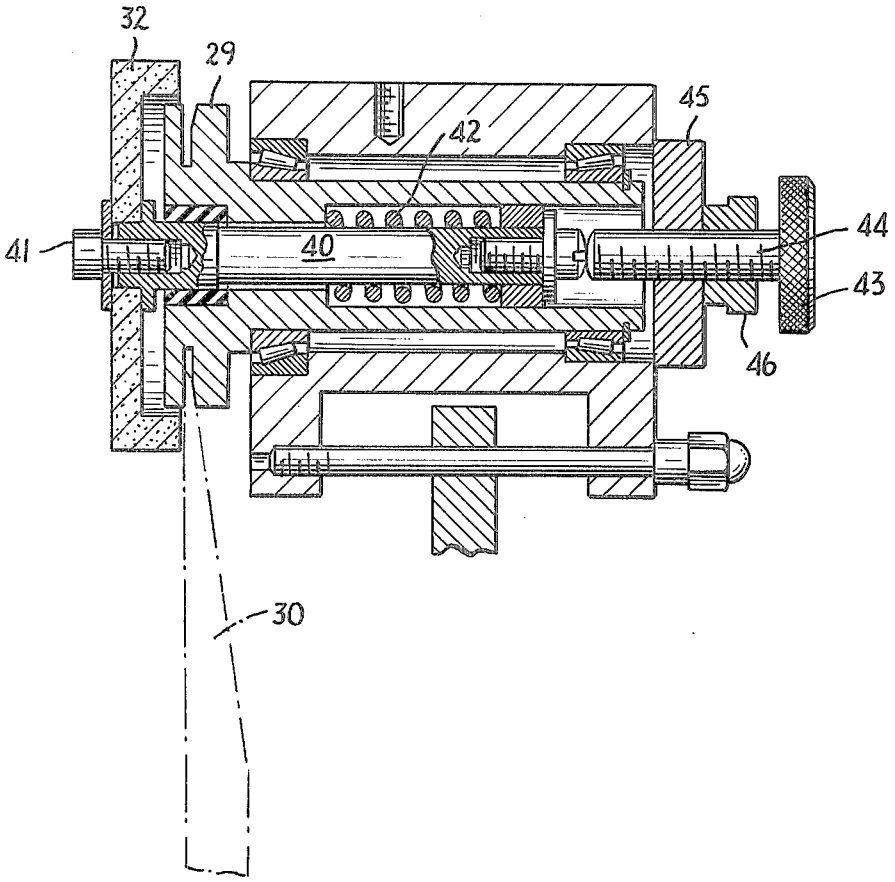
FIG. 6 is a view with some parts in section, along the line 6—6 of FIG. 2.

Referring to FIGS. 4 and 5 the form of the bracket 28 and the manner of affixing the honing head assembly 25 to such bracket will be seen. The honing head assembly 25 is affixed to the leg 28*a* of the bracket 28 by means of a rod 50 passing through the leg 28*a* and two legs of a U-shaped portion 49 of the honing head assembly. Such rod is secured in a fixed position by a pair of locking nuts 51 and is spring loaded by a spring 52. The leg 28*a* can be adjusted sideways to insure that the honing head assembly is properly positioned with respect to the knife blade for correct tracking of the hones on the blade. The leg 28*a* can be set in position by means of a set screw 53 keyed to the rod 50.

Such rod 50 serves as a tracking angle pivot around which the honing head assembly can be rotated to change the tracking angle of the hones. Such rotation and change in tracking angle is accomplished by means of a tracking angle adjusting arm 48, affixed to the honing head assembly with screws 48*a*, and a tracking angle adjusting link 48*b*. The arm 48 and the link 48*b* are connected by a pin 47 so that movement of the link 48*b* will rotate the entire honing head assembly around the tracking angle pivot 50. To lock the link 48*b* and interconnected honing head assembly in a desired position such link 48*b* is provided with a slot 48*c* through which it is secured to the bracket 28 by a tracking angle locking screw 27. The link 48*b* can be moved along the slot 48*c* and locked in the desired position by tightening the screw 27.

The initial tracking angle is established by adjusting the complete hone assembly about the tracking pivot 50 until both the angled and vertical hones contact the knife edge at their respective grinding points. The assembly is then locked in the proper position by the tracking arm 48, the adjustable line 48*b* and the locking screw 27 (FIG. 4). The location of such pivot point and the length of the hone arm (determined by position of honing head assembly on arm) are to be selected so that the angle of travel of the arm coincides, on a point to point basis, with the change in tracking angle that results from the changing radii of the two grinding points where the angled hone 31 and the vertical hone contact the knife.

When the hone assembly is not in use the hone arm rests in the groove of the rest arm 24 mounted on the front bearing housing (FIG. 1A). Such groove is generally aligned with the knife blade when the rest arm is positioned normal to the blade. If the hone arm does not properly rest in such groove the position of the U-shaped bracket 12 is adjusted on the front bearing housing. When the blade is to be honed, the rest arm 24 is turned out of the way and the hone arm 16 is lowered toward the blade. If the guide wheel 29 is not centered on the blade the position of the wheel can be adjusted by means of the threaded centering screw 50 and locked by the set screw 53. In the various adjustments described, it is necessary for proper hone function to align the hone pivot shaft 40 so that it is parallel with the knife shaft in the horizontal and vertical planes. When the guide wheel 29 is centered on the cutting edge and properly aligned it will maintain tracking from the highest to lowest point while rotating the blade. After such guide wheel is properly set the angled hone 31 can be adjusted in toward the beveled edge of the blade. Once the hone is properly set the blade can be rotated until cutting edge area is polished. The angled hone can then be backed off, after which the vertical hone 32 is adjusted to apply proper pressure against the back of the blade. The blade is then rotated to remove the burrs from the back of the blade.

When the hones pass over the gap in the involute knife edge, the dashpot or cylinder 20, coupled between the chassis of the machine and mounting for the hone arm 16, serves to control the drop of the hone assembly from the high part of the knife edge to the low part of the knife edge.

It will be seen that the rotating knife blade is in the form of a helix and that the hone arm carrying the hone assembly will change its angular position with respect to the helix according to the change in radius of the knife blade. Since it is necessary to increase the angle at the smaller radii (smaller portion of the blade), the pivot point of the hone arm and the position of the hone assembly on the arm are so set that the angle of the arm relative to the knife changes at the same rate as the change in cam rise of the blade to the radius of the blade.

Thus, among others, the several aforenoted objects and advantages are most effectively attained. Although a somewhat preferred embodiment of the invention has been disclosed and described in detail herein, it should be understood that this invention is in no sense limited thereby and its scope is to be determined by that of the appended claims.

Having thus described the invention what is claimed is:

1. A hone for sharpening the cutting edge of a rotary involute knife blade mounted on a shaft comprising:

a hone arm pivotally connected at one end to a support in fixed position with respect to said shaft, the axis of the said pivot being parallel to the said shaft to permit the arm to rotate around the pivot in a plane parallel to the plane of the knife blade and through a tracking angle to compensate for changes in the radii of the cutting edge of the knife blade;

a grinding assembly affixed to the other end of the said hone arm by adjustable mounting means;

said grinding assembly comprising:

a. guide means contacting said blade adjacent the cutting edge;

b. a first grinding wheel mounted at an angle to the plane of the blade to be sharpened; and c. means interconnecting the guide means and first grinding wheel to position said first grinding wheel with respect to said cutting edge;

said mounting means comprising adjustments to rotate the grinding assembly around the hone arm, to rotate the grinding assembly with respect to the mounting means to adjust the tracking angle, and to move the grinding assembly sideways with respect to the mounting means and the knife blade;

the pivot point of the said hone arm and the point of attachment of the grinding assembly to the said hone arm being so positioned that the first grinding wheel will make proper contact with the cutting edge at any radius of the blade and over the entire path of the cutting edge.

2. The hone of claim 1 in which a dashpot is interconnected to the hone arm to prevent sudden movement of the grinding assembly and control the drop of the grinding assembly from the high part of the knife edge to the low part of the knife edge.

3. The hone of claim 1 in which the grinding assembly includes a second grinding wheel mounted in a plane parallel to the plane of the knife blade, the said second grinding wheel being interconnected to the said guide means to position said second grinding wheel so that it will make proper contact with the back of the cutting edge to remove any burrs from the back of the blade.

4. The hone of claim 1 in which the grinding assembly comprises adjustable spring means for holding the first grinding wheel in firm contact with the knife edge.

5. The hone of claim 1 in which the grinding assembly comprises adjustable spring means for holding the second grinding wheel in firm contact with the back of the blade at the cutting edge.

6. A hone for sharpening the cutting edge of a rotary involute knife blade mounted on a shaft comprising:

a hone arm pivotally connected at one end to a support in fixed position with respect to said shaft, the axis of the said pivot being parallel to the said shaft to permit the arm to rotate around the pivot in a plane parallel to the plane of the knife blade and through a tracking angle to compensate for changes in the radii of the cutting edge of the knife blade; and a grinding assembly affixed to the other end of the said hone arm by adjustable mounting means;

said grinding assembly comprising:

a. guide means contacting said blade adjacent the cutting edge;

b. a first grinding wheel mounted at an angle to the plane of the blade to be sharpened to grind the front edge of the blade; and c. a second grinding wheel mounted in a plane parallel to the plane of said blade to grind the back edge of the blade;

d. the said grinding assembly maintaining the guide means and wheels in fixed relation and being rotatable about a tracking pivot to permit selection of a tracking angle for the said grinding wheels which will cause the wheels to contact the blade edge at their respective grinding points;

said mounting means comprising adjustments to rotate the grinding assembly around the hone arm, to rotate the grinding assembly with respect to the mounting means to adjust the tracking angle, and to move the grinding assembly sideways with respect to the mounting means and the knife blade;

the said tracking pivot and the position of the said grinding assembly along the length of the said hone arm being so located that the angle of travel of the said hone arm will coincide, on a point to point basis, with the change in tracking angle that will result from the changing radii of the two grinding points where the said first and second wheels contact the knife.

* * * * *